US005201642A

United States Patent [19]

Hinckley

[11] Patent Number: 5,201,642

[45] Date of Patent: Apr. 13, 1993

[54] MAGNETIC DRIVE PUMP

[75] Inventor: Charles J. Hinckley, Hardwick, Mass.

[73] Assignee: Warren Pumps, Inc., Warren, Mass.

[21] Appl. No.: 800,058

[22] Filed: Nov. 27, 1991

[51] Int. Cl.[5] ..... F04B 17/00

[52] U.S. Cl. ..... 417/420; 415/115; 415/170.1; 415/206

[58] Field of Search ..... 417/420; 415/170.1, 415/173.1, 206, 115

[56] References Cited

U.S. PATENT DOCUMENTS

| | | | |
|---|---|---|---|
| 1,141,556 | 6/1915 | Krogh | 415/170.1 |
| 2,741,991 | 4/1956 | Disbrow | 415/170.1 |
| 3,079,866 | 3/1963 | Walker | 415/173.1 |
| 3,398,696 | 8/1968 | Sproule | 415/170.1 |
| 3,600,101 | 8/1971 | Oglesby | 415/170.1 |
| 3,881,840 | 5/1975 | Bunjes | 415/170.1 |
| 4,047,847 | 9/1977 | Oikawa | 417/420 |
| 4,226,574 | 10/1980 | Villette | 417/420 |
| 4,245,952 | 1/1981 | Eberhardt | 415/170.1 |
| 4,722,661 | 2/1988 | Mizuno | 417/420 |
| 4,780,066 | 10/1988 | Bolleter | 417/420 |
| 4,850,818 | 7/1989 | Kotera | 417/420 |
| 5,066,200 | 11/1991 | Ooka | 417/420 |

*Primary Examiner*—Richard A. Bertsch
*Assistant Examiner*—Peter Korytnyk
*Attorney, Agent, or Firm*—Blodgett & Blodgett

[57] ABSTRACT

A magnetic drive pump which is a type of sealers pump which utilizes magnets to drive an internal rotating assembly consisting of an impeller and inner magnet ring which is located in a containment shell. An outer magnet ring is located outside of the containment shell and is driven by outside driving means. There is no internal drive shaft. The impeller is rotatably mounted on journal bearings and an inner magnet ring is supported from the impeller in cantilever fashion.

7 Claims, 2 Drawing Sheets

MAGNETIC DRIVE PUMP

BACKGROUND OF THE INVENTION

The present invention relates generally to a sealless pump for fluids and is particularly directed to a magnetic drive pump which is a sealless pump in which an impeller is located in a first compartment and a drive means is located in a second compartment which is completely closed from the first compartment by a containment can. A first magnet ring is fixed to the impeller. A second magnet ring is fixed to the drive means and is in driving alignment with the first magnet ring. The second magnet ring is rotated by the drive means which, in turn, causes the first magnet ring to rotate along with the impeller which is attached to the first magnet ring. The impeller is fixed to a shaft which is journaled to the pump housing. The impeller extends in cantilever fashion from one end of the shaft. The impeller has an inlet orifice which faces the inlet opening of the pump housing and an outlet orifice which faces the outlet of the pump housing. A hardened inner wear ring is fixed to the impeller between the inlet and outlet orifices. There is a relatively small gap between the inner and outer wear rings which prevents contact between the rings during running of the pump and limits the back flow of liquid through the gap to the inlet opening.

One of the major problems which has to be dealt with in the sealless magnetic coupling pumps described above, is the generation of heat in the containment can by eddy currents from the magnetic coupling. In order to deal with the problem of generated heat within the pump, the pump housing is provided with passageways for conveying some of the fluid which emerges from the outlet orifice of the impeller to the compartment which contains the inner magnet ring for the purpose of cooling the containment can and lubricating the journal bearings. The fluid passes back to the impeller through the journal bearings of the shaft and also cools the bearings and the shaft. If the temperature of the magnetic drive components is not kept under control, the journal bearings become too hot and lock, resulting in damage to one or more of the drive components. The flow of fluid through the journal bearings must be sufficient to maintain the temperature of the bearings and shaft below a critical temperature. At the same time, this back flow reduces the pumping efficiency of the pump. These and other difficulties experienced with the prior art sealless pumps have been obviated by the present invention.

It is, therefore, a principle object of the invention to provide a magnetic drive pump which does not require journal bearings in the containment can area, thereby reducing generated heat within the coupling area and eliminating the problem of bearing lock from heat generated by the magnetic coupling.

Another object of this invention is the provision of a magnetic drive pump which permits a reduced back flow of liquid from the magnetic coupling region of the pump to the inlet opening of the pump, thereby resulting in increased pumping efficiency.

A further object of the present invention is the provision of a magnetic drive pump in which the wear rings, which are normally associated with the impeller, function as both back flow limitating devices and journal bearings for the impeller and components which are directly connected to the impeller, including the driven magnet ring and are the only bearings needed for these components.

It is another object of the present invention to provide a magnetic drive pump in which journal bearings of the impeller are isolated from the magnetic coupling components and are thereby unaffected by the heat which is generated by the magnetic coupling components.

A still further object of the invention is the provision of a magnetic drive pump in which journal bearings for the impeller are located near the inlet opening of the pump housing and are located upstream or at the relatively cool portion of the back flow of pumped fluid which is used for cooling the magnetic coupling means so that the general bearings are unaffected by heat which is generated from the magnetic drive coupling.

It is a further object of the invention to provide a magnetic drive pump which is much simpler and compact in construction than conventional pumps of this type and which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention consists of a magnetic drive pump in which the chamber of the pump housing is divided into inner and outer compartments which are completely separated from each other by a pressure containing can. A driven magnet ring is fixed to the impeller and both are located in one of the compartments. A driving magnet ring is located in the other compartment so that it is in driving alignment with the driven ring. The driving magnet ring is rotated about an axis by outside power means. The impeller is journaled to the housing for rotation about the axis relative to the housing and the driven magnet ring extends from the impeller in cantilever fashion. More specifically, the journaled bearings for the impeller are located on the impeller and also serve as wear rings which are normally associated with the impeller.

BRIEF DESCRIPTION OF THE DRAWINGS

The character of the invention, however, may be best understood by reference to one of its structural forms, as illustrated by the accompanying drawings, in which.

DESCRIPTION OF THE PRIOR ART

Figure 1:
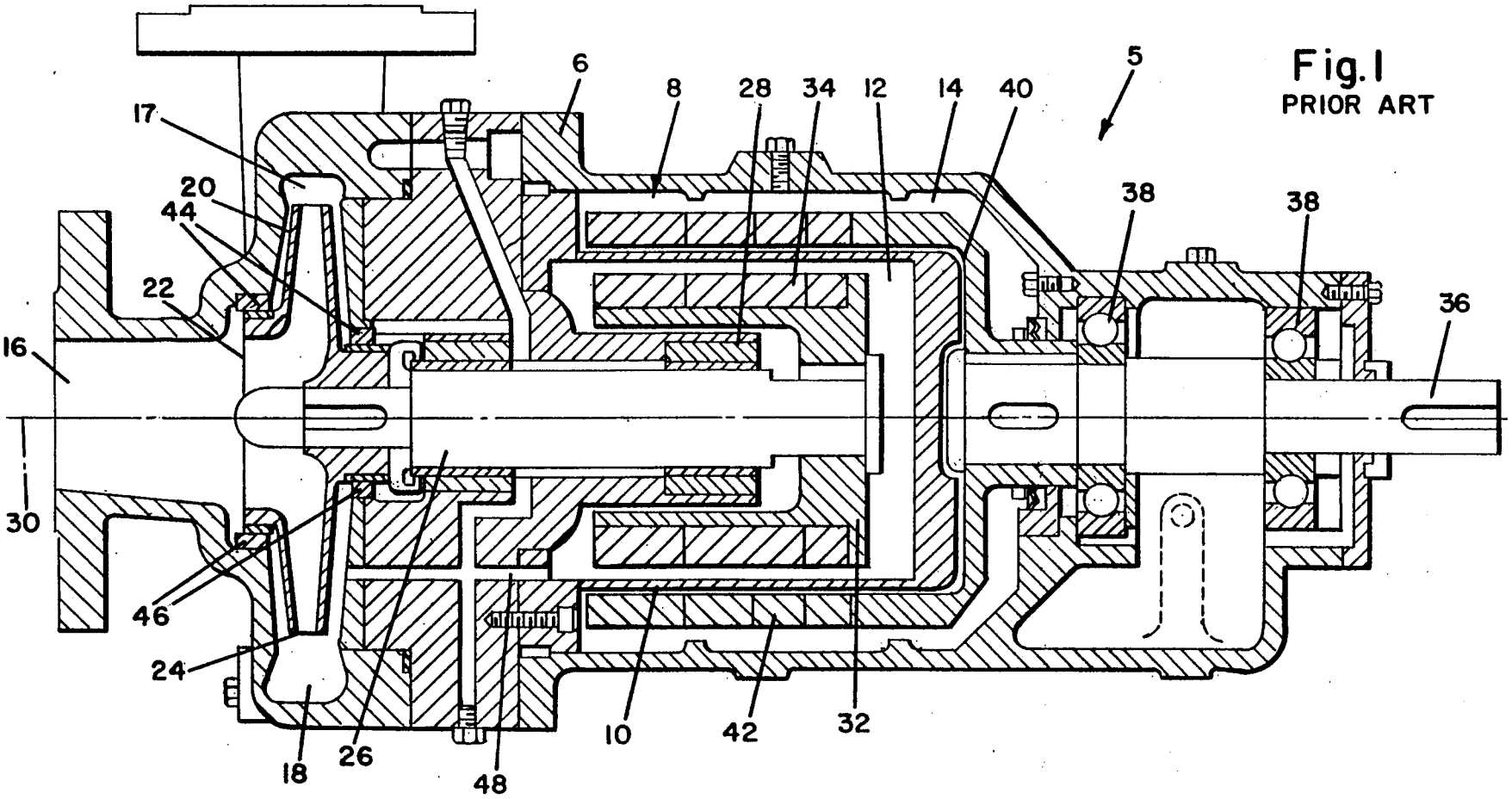
Fig. 1 PRIOR ART
FIG. 1 is a cross-sectional view of a prior art magnetic drive pump and labeled "prior art"

Referring first to FIG. 1, there is shown a magnetic drive pump which is typical of prior art pumps of this type. The prior art pump shown in FIG. 1 is generally indicated by the reference numeral 5 and comprises a casing or housing 6 which has a chamber which is generally indicated by the reference numeral 8. The chamber 8 is divided into an inner compartment 12 and an outer compartment 14 by a cylindrical canshaped containment shell 10. The pump 5 has an inlet opening 16 and an outlet opening 18 at one end of the pump. A plenum 17 is located between the inlet and outlet openings 16 and 18, respectively. An impeller 20 is located within the plenum 17 and has an inlet orifice 22 which faces the inlet opening 16 and an outlet orifice 24 which faces the outlet opening 18. The impeller 20 is fixed to the end of a pump shaft 26 which is mounted withthin the housing for rotation about a central longitudinal axis 30 by means of journal bearings 28. Impeller 20 is fixed to one end of the shaft 26 so it lies near the inlet opening 16. A holder 32 is fixed to the opposite end of the shaft 26 and supports an inner magnet ring 34 which is concentric with the axis 30 and lies within the can-shaped containment shell 10. A drive shaft 36 is mounted for rotation about the axis 30 at the end of the housing which is opposite from the inlet opening 16. The drive shaft 36 is supported for rotation relative to the housing 6 by means of bearings 38. A holder 40 is fixed to the inner end of the shaft 36 and supports an outer magnet ring 42 in the compartment 14 just outside of the containment shell 10. The outer magnet ring 42 is concentric with the axis 30 and is in driving alignment with the inner magnet ring 34. The outer end of the shaft 36 is keyed to conventional drive means, not shown. Rotation of the shaft 36 by conventional drive means causes the outer magnet ring 42 to rotate about the axis 30. This causes the inner magnet ring 34 to rotate above the axis 30 as a result of the magnetic attracting forces between the two magnets. Rotation at the inner magnet ring 34 causes the pump shaft 26 to rotate thereby rotating the impeller 20 about the axis 30. Rotation of the impeller 20 causes the fluid which is to be pumped by the pump 5 to be drawn into the inlet orifice 22 from the inlet opening 16 and forced through the outlet opening 18 from the outlet orifice 24 of the impeller. Some of the fluid is forced through the passageway 48 to the inner magnet ring 34 and through the journal bearings 28 back through the wearings 44. The "back flow" of liquid cools the magnet rings and bearings. Heat is generated by the magnetic drive coupling and to a lesser degree, by the bearings 28. The back flow of product fluid removes heat from the bearings and magnet rings. Some heat is developed due to the relative commotion of the bearing elements. Most of the heat is developed as a result of eddy current losses in the containment can from the rotating magnetic fields. Random electrical currents are generated in a conductive material when a magnetic field is rotated around it. These currents are normally dissipated as heat due to the electrical resistance of the material. If this heat is allowed to build up, a critical temperature would be reached which would cause the bearings to lock, resulting in serious damage to the drive components of the pump or in permanent damage to the pump. The removal of heat from the magnet rings and bearings by the back flow of product fluid prevents this critical temperature from being reached. The back flow of fluid must be sufficient to maintain the temperature within the containment shell below a critical temperature. Although the back flow of fluid reduces pump deficiency, it is critical for keeping the pump running and to prevent failure from over heating of the bearings.

DETAILED DESCRIPTION OF THE INVENTION

Figure 2:
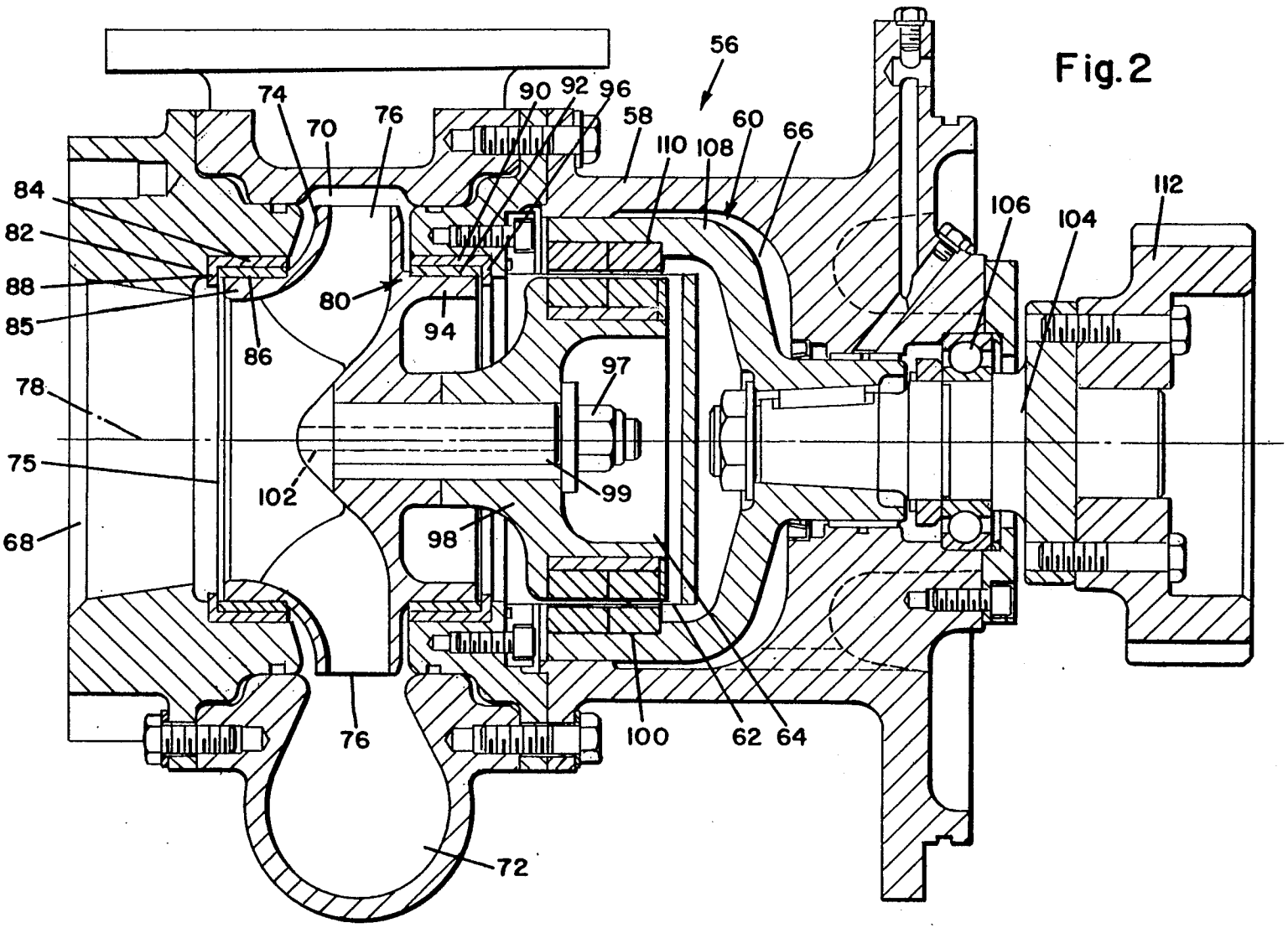
FIG. 2 is a cross-sectional view of a magnetic pump embodying the principles of the present invention.

Referring to FIG. 2, there is shown a cross-section of a magnetic drive pump which embodies the principles of the present invention and which is generally indicated by the reference numeral 56. The pump 56 includes a housing or a casing 58 which has an interior chamber, generally indicated by the reference numeral 60. The chamber 60 is divided into an inner compartment 64 and an outer compartment 66 by a can-shaped containment shell 62. An inlet opening 68 and an outlet opening 72 are located at one end of the housing. A plenum 70, which is part of the inner compartment 64, is located between the inlet opening 68 and the outlet opening 72. An impeller 72 is located in the plenum 70 and has a central inlet orifice 75 which faces the inlet opening 68 and an annular outlet orifice 76 which faces the outlet opening 72. The impeller 72 is mounted for rotation about a central longitudinal axis 78 relative to the housing 58. The impeller 72 is rotatably mounted on journal bearings which are generally indicated by the reference numerals 80 and 82. Journal bearing 82 includes a bushing 84 which is fixed to the housing and a sleeve 86 which is fixed to a circular outer flange 85 of the impeller 72. The journal bearing 80 includes a bushing 90 which is fixed to the housing and a sleeve 92 which is fixed to a circular inner flange 94 of the impeller 72. The bushing 84 has a first circular flange 88 which is normal to the bushing and the axis 78 and extends inwardly towards the axis 78 between the sleeve 86 and the housing 58 for preventing axial movement of the impeller toward the inlet opening 68. The bushing 90 has a second circular flange 96 which is normal to the bushing 90 and the axis 78 and extends inwardly toward the axis 78 between the sleeve 92 and the housing 58 for preventing axial movement of the impeller away from the inlet opening 68. The journal bearings 80 and 82 are located in the same general area as the wear rings of conventional magnetic drive pumps and perform the same function as conventional wear rings to limit the back flow of fluid from the impeller, in addition to their function as bearings for rotatably supporting the impeller 74 within the housing 58.

A holder 98 is fixed to the inner side of the impeller 72 by a bolt 99 and a nut 97. A bore or central passageway 102 extends entirely through the bolt 99 and nut 97 to enable fluid to pass from within the containment shell 62 to the inlet opening 75 of the impeller. The holder 98 supports an inner magnet ring 100 within the containment shell 62.

A drive shaft 104 is rotatably mounted in a bearing 106 at the end of the housing 58 which is opposite from the inlet opening 68. The inner end of the shaft 104 is fixed to the holder 108 which supports an outer magnet ring 110 which is located in the compartment 66 just outside of the containment shell 62. The inner and outer magnet rings 100 and 110, respectively, are concentric with the axis 78 and are in driving alignment. The outer end of the shaft 104 is fixed to a driving element, such as a gear 112 for rotation by drive means (not shown) about the axis 78. Rotation of the shaft 104 causes the outer magnet ring 110 to rotate which, in turn, causes the inner magnet ring 100 to rotate about the axis 78. Rotation of the inner magnet ring 100 causes the impeller 72 to rotate about the axis 78 for pumping product fluid from the inlet opening 68 to the outlet opening 72. There is a small gap between the bushing and sleeve of each of the bearings 80 and 82. Product fluid passes between the gaps of the bearings to provide fluid lubrication between the bushing and sleeve of each bearing. The sleeve and bushing of each bearing is made of a hard non-galling, non-corrosive material, such as silicon carbide. Product fluid which passes through the gap between the bushing and sleeve of the bearing 80 enters the interior of the containment shell 62 and flows back through the central passageway 102 to the inlet orifice 75. The flow of product fluid removes heat which is generated by the magnet rings 100 and 110. However, the bearings 80 and 82 are unaffected by heat from the magnet rings.

They are spaced sufficiently from the magnetic drive components and the product fluid flows through the bearings 80 and 82 prior to reaching the magnetic drive components. The bearings 80 and 82 perform a triple function. First, they function as backflow limiting devices in essentially the same manner as the wear rings in conventional magnetic drive pumps. Second, they function as journal bearings for the impeller and inner magnet ring, and third, they function as thrust bearings for the impeller.

Clearly, minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A magnetic drive pump for a product fluid comprising:

(a) a housing having a central longitudinal axis, a chamber, an inlet opening at one end of the housing and an outlet opening which is spaced from said inlet opening, (b) a cylindrical containment shell within said chamber which is concentric with said axis and which divides said chamber into an inner compartment and an outer compartment, said inner and outer compartment being completely separate from each other, said inlet and outlet openings being connected to said inner compartment, (c) a drive shaft at an end of said housing which is opposite said one end and which is mounted on said housing for rotation about said axis, said drive shaft extending beyond said housing, (d) an outer magnet ring which is located in said outer compartment and which is concentric with said axis, (e) a first holder which is fixed to said outer magnet ring, said holder being coupled to said drive shaft so that said outer magnet ring rotates about said axis when said drive shaft rotates, (f) an inner magnet ring which is located in said inner compartment within said outer magnet ring and which is concentric with said axis, (g) an impeller which is located within said inner compartment and which is journaled to said housing for rotation about said axis relative to said housing, said impeller being effectively positioned between said inlet and outlet openings for conveying product fluid from said inlet opening to said outlet opening upon rotation of said impeller, and (h) a second holder which is fixed to and supports said inner magnet ring, said second holder being fixed to said impeller so that rotation of said outer magnet ring causes rotation of said inner magnet ring and said impeller, said second holder being cantilevered from said impeller and supported entirely by said impeller.

2. A magnetic drive pump as recited in claim 1, wherein said impeller has an inlet orifice which faces the inlet opening of said housing and an outlet orifice which is normal to said inlet orifice which faces the outlet opening of said housing, said impeller comprising:

(a) an outer circular flange which faces said inlet opening, said outer flange being concentric with said axis, (b) an inner circular flange which is spaced from said outer flange and which extends away from said inlet opening, said inner flange being concentric with said axis, said outlet orifice being located between said outer and inner circular flanges, (c) an outer journal bearing means between said outer flange and said housing, and (d) an inner journal bearing means between said inner flange and said housing.

3. A magnetic drive pump as recited in claim 2, wherein each of said outer and inner journal bearing means comprises:

(a) a cylindrical sleeve which is fixed to a respective one of said circular flanges, said cylindrical sleeve being concentric with said axis, and (b) a cylindrical bushing which is fixed to said housing, said bushing being concentric with said axis and being spaced from its respective cylindrical sleeve by a predetermined gap which communicates with said inlet opening and which is sufficient to enable lubrication to occur between said sleeve and said bushing by the product fluid which is being pumped.

4. A magnetic pump as recited in claim 3, wherein said inner and outer journal bearing means comprises thrust bearing means for preventing axial movement of said impeller.

5. A magnetic drive pump as recited in claim 3, wherein a passageway extends through said second holder and said impeller from said inner compartment to said inlet opening for conveying fluid which passes through the gaps in said inner and outer journal bearing means from said inner compartment to the inlet opening of said housing.

6. A magnetic drive pump for a product fluid comprising:

(a) a housing having a central longitudinal axis, a chamber, an inlet opening at one end of the housing and an outlet opening which is spaced from said inlet opening, (b) a cylindrical containment shell within said chamber which is concentric with said axis and which divides said chamber into an inner compartment and an outer compartment, said inner and outer compartment being completely separate from each other, said inlet and outlet openings being connected to said inner compartment, (c) a drive shaft at an end of said housing which is opposite said one end and which is mounted on said housing for rotation about said axis, said drive shaft extending beyond said housing, (d) an outer magnet ring which is located in said outer compartment and which is concentric with said axis, (e) a first holder which is fixed to said outer magnet ring, said holder being coupled to said drive shaft so that said outer magnet ring rotates about said axis when said drive shaft rotates, (f) an inner magnet ring which is located in said inner compartment within said outer magnet ring and which is concentric with said axis, (g) an impeller which is located within said inner compartment and which is journaled to said housing for rotation about said axis relative to said housing, said impeller being effectively positioned between said inlet and outlet openings for conveying product fluid from said inlet opening to said outlet opening upon rotation of said impeller, said impeller having an inlet orifice which faces the inlet opening and an outlet orifice which is normal to said inlet orifice which faces the outlet opening of said housing, said impeller comprising:

(1) an outer circular flange which faces said inlet opening said outer flange being concentric with said axis, (2) an inner circular flange which is spaced from said outer flange and which extends away from said inlet opening, said inner flange being concentric with said axis, said outlet orifice being located between said outer and inner circular flanges, (3) an outer journal bearing means between said outer flange and said housing, and (4) an inner journal bearing means between said inner flange and said housing, each of said outer and inner journal bearing means having a cylindrical sleeve which is fixed to a respective one of said circular flanges, said cylindrical sleeve being concentric with said axis, and a cylindrical bushing which is fixed to said housing, said bushing being concentric with said axis and being spaced from its respective cylindrical sleeve by a predetermined gap which communicates with said inlet opening and which is sufficient to enable lubrication to occur between said sleeve and said bushing by the product fluid which is being pumped, each of said inner and outer journal bearing means being thrust bearing means for preventing axial movement of said impeller, each of said thrust bearing means having a first circular flange which is fixed to the bushing of said outer journal bearing means, said first circular flange being normal to said axis and extending toward said axis between the sleeve of said outer journal bearing means and said inlet opening for preventing axial movement of said impeller toward said inlet opening, and a second circular flange which is fixed to the bushing of said inner journal bearing means, said second circular flange being normal to said axis and extending toward said axis between the sleeve of said inner journal bearing means and said outer magnet ring for preventing axial movement of said impeller away from said inlet opening, and (h) a second holder which is fixed to and supports said inner magnet ring, said second holder being fixed to said impeller so that rotation of said outer magnet ring causes rotation of said inner magnet ring and said impeller, said second holder being cantilevered from said impeller and supported entirely by said impeller.

7. A magnetic drive pump for a product fluid comprising:

(a) a housing having a central longitudinal axis, a chamber, an inlet opening at one end of the housing and an outlet opening which is spaced from said inlet opening, (b) a cylindrical containment shell within said chamber which is concentric with said axis and which divides said chamber into an inner compartment and an outer compartment, said inner and outer compartment being completely separate from each other, said inlet and outlet openings being connected to said inner compartment, (c) a drive shaft at an end of said housing which is opposite said one end and which is mounted on said housing for rotation about said axis, said drive shaft extending beyond said housing, (d) an outer magnet ring which is located in said outer compartment and which is concentric with said axis, (e) an inner magnet ring which is located in said inner compartment within said outer magnet ring and which is concentric with said axis, (f) a first holder which is fixed to one of said magnet rings, said holder being coupled to said drive shaft so that said one magnet ring rotated about said axis when said drive shaft rotates, (g) an impeller which is located within said inner compartment and which is journaled to said housing for rotation about said axis relative to said housing, said impeller being effectively positioned between said inlet and outlet openings for conveying product fluid from said inlet opening to said outlet opening upon rotation of said impeller, said impeller comprising:

(1) an outer circular flange which faces said inlet opening, said outer flange being concentric with said axis, (2) an inner circular flange which is spaced from said outer flange and which extends away from said inlet opening, said inner flange being concentric with said axis, said outlet orifice being located between said outer and inner circular flanges, (3) an outer journal bearing means between said outer flange and said housing, and (4) an inner journal bearing means between said inner flange and said housing, and (h) a second holder which is fixed to and supports the other of said inner magnet rings, said second holder being fixed to said impeller so that rotation of said one magnet ring causes rotation of said other magnet ring and said impeller, said second holder being cantilevered from said impeller and supported entirely by said impeller.

* * * * *